United States Patent [19]

Arnold

[11] 4,299,64

[45] Nov. 10, 198

[54] HEAT TRANSFER DECAL

[75] Inventor: Raymond M. Arnold, West Chester, Pa.

[73] Assignee: Advanced Graphic Technology, Chicago, Ill.

[21] Appl. No.: 73,554

[22] Filed: Sep. 6, 1979

[51] Int. Cl.[3] ..... B44C 1/24

[52] U.S. Cl. ..... 156/230; 156/277; 260/33.4 R; 260/33.2 R; 260/31.2 R; 427/407.1; 427/411

[58] Field of Search ..... 260/33.4 R, 33.2 R, 260/31.2 R; 427/407.1, 411; 156/230, 277

[56] References Cited

U.S. PATENT DOCUMENTS

| | | | |
|---|---|---|---|
| 3,764,587 | 10/1973 | Zunker | 260/33.8 U |
| 3,919,150 | 11/1975 | Kiel | 260/33.2 |
| 4,136,076 | 1/1979 | Daniels | 260/33.4 |
| 4,138,522 | 2/1979 | Ishizuka | 260/33.2 |
| 4,177,076 | 12/1979 | Sato | 260/33.4 |

*Primary Examiner*—Paul R. Michl

*Attorney, Agent, or Firm*—Allegretti, Newitt, Witcoff McAndrews

[57] ABSTRACT

A method for producing a multicolor heat transf decal comprises printing specially formulated therm plastic inks successively onto a pre-release coated ca rier sheet. The inks give optimum print quality usir plastic printing plates and a rotary letterpress or flex graphic printing process.

7 Claims, 1 Drawing Figure

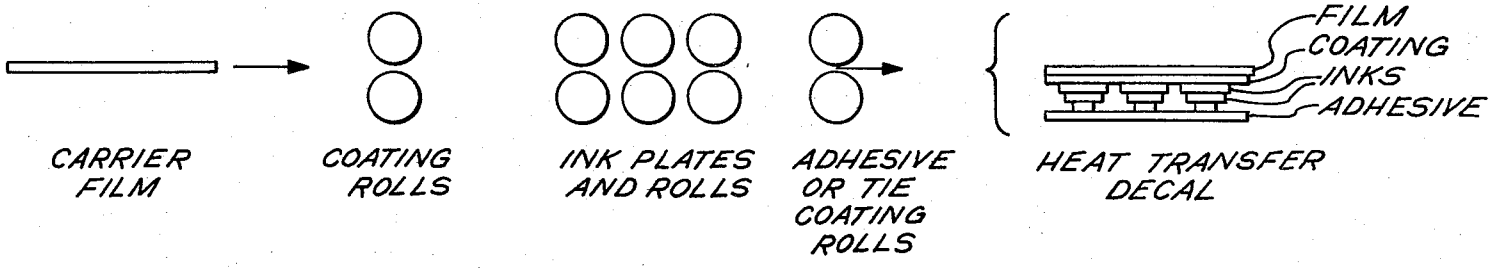
FILM
COATING
INKS
ADHESIVE
HEAT TRANSFER DECAL
ADHESIVE OR TIE COATING ROLLS
INK PLATES AND ROLLS
COATING ROLLS
CARRIER FILM

HEAT TRANSFER DECAL

BACKGROUND OF THE INVENTION

This invention relates to multicolor heat transfer decals particularly as used to decorate plastic articles.

In order to produce heat transfers that give high quality images and show clear and brilliant colors, a screen process (e.g. silk screen) was originally used. The screen process enabled a printer to formulate inks that were compatible with the various plastics to be decorated since there were virtually no restrictions on the solvents that could be used to dissolve the resins that were needed to make the inks. Screen process inks are conventionally made using slow drying solvents such as white spirit, high boiling aromatics, ketones and glycol ethers.

To satisfy a larger volume market for heat transfers that could not be met by the comparatively slow silk screen process, various methods were devised using a gravure printing process. Gravure printing has the advantage that almost any solvent system can be used due to the solvent impervious etched metal rollers that are used to carry out gravure printing. For example, very fast evaporating solvents such as toluene, methylethylketone and N-propyl acetate are used.

Many of the gravure heat transfer systems employ an adhesive layer or a wax to bond conventional printing inks down onto the final receptor surface or carrier film. U.S. Pat. Nos. 2,862,332 and 2,989,413 disclose examples of such a wax bonding system. The wax acts as a release system and as a bonding agent.

Other systems have a release layer similar to that used in the foil stamping industry. Such release layers are commonly mixtures of waxes and a high molecular weight acrylic. The inks associated with such systems are based on resins that are only soluble in very active solvents.

There are serious disadvantages in using either silk screen process or gravure process. The screen process is very slow and requires new screens each time a particular design is run since the screens are very susceptible to damage. With such processes, very fine color process printing beyond 60-80 lines per inch is difficult thereby seriously limiting the quality of work that can be produced. The nature of the processes preclude close register of prined material.

Since heat transfers are generally required in a roll or web format, screen printing machines having the ability to print on web form have been developed. However, they are very costly and require highly trained operating personnel.

The gravure process is ideal for producing high quality heat transfers. Thermoplastic inks printed over release coated film give the finest print quality. However, this too is a very costly process. The printing equipment is very expensive and the costs of preparing gravure cylinders is extremely high since highly skilled personnel are necessary for their manufacture. A gravure processing plant has a high capital cost further escalating the cost.

Alternative processes have been proposed. Various early heat transfers were printed using rubber plates on conventional flexographic equipment. However, the rubber plates give very poor quality reproduction and the inks used are not thermoplastic. Also, a secondary adhesive coating must be applied to give adhesion to the articles being decorated. The colors are very weak and tend to be transparent and have very poor resistance abrasion. Consequently, this early process was disco tinued.

In recent times the invention of plates made fro photopolymer resins such as Dupont Cyrel ® resin ar or BASF Nyloprint ® resin plates has resulted in a hig quality plate that can give resolution and definition letterpress printing much closer to that achieved by tl gravure process. The solvent system that can be use with these "plastic" plates, however, is still similar that used with the older rubber printing plates althoug the plastic plates will tolerate a higher percentage more active solvent in the inks. Commonly used sc vents therefore consist mainly of ethanol or isopropan with additions in the order of 10% of propyl acetat nitropropane and glycol ethers.

SUMMARY OF THE INVENTION

The present invention comprises the discovery inks and their use to provide required heat transf characteristics when printed on heat activated relea coated material such as wax or resin coated polyest film or polymer coated paper e.g. polypropylene c kraft paper. The inks can be printed using the "plastic printing plates and result in a method of producing he transfers that eliminate the disadvantages of the pri art gravure or screen processes. The resultant product a very high quality heat transfer product having a con petitive cost.

The machines used to print the heat transfers a conventional rotary letterpress or flexographic press which are commonly available and which have a muc lower capital cost than either web fed gravure press of web screen presses. Such presses can also be operate by their normal operators. The plastic printing plat also can be readily made using conventional processir equipment and normal personnel. The cost of suc plates is only a fraction of the cost of gravure cylinder Such plates also have the added advantage of bein readily stored for use with subsequent orders.

In order to utilize the ease of print that the flex graphic process offers and yet obtain the resistance solvent and adhesion of more difficult to decorate su faces, it is possible to utilize a combination gravure an plastic plate, flexographic process. For example, a gr vure unit may be used for the first step to deposit release coating. If the substrate or carrier film is alread release coated (as is the normal case) another protecti coating gives added abrasion or solvent resistanc Upon transference this first applied coating becomes tl uppermost layer. Also, use of a gravure unit after he transfer inks are laid down over the release coatin allows the application of tie coats to give improve adhesion to difficult surfaces. In both of these gravu steps the coating would be continuous over the who surface and not in register with the ink design element This would permit utilization of simple coating rolle that could be used with all and any designs.

Thus it is an object of the present invention to pr vide an improved method of printing heat transfers b means of inexpensive flexographic processes using ine pensive flexographic plates.

A further object of the present invention is to provic improved heat transfer ink formulations which may b used for various printing processes for the manufactu of heat transfer decals.

Still another object of the present invention is to provide a method of manufacture of a heat transfer from carrier film particularly to a plastic surface wherein the transfer has high abrasion resistance and durability.

Another object of the present invention is to provide an inexpensive method for manufacture of heat transfers using currently available printing equipment in combination with new and specific formulations of heat transfer ink.

These and other objects, advantages and features of the invention will be set forth in the detailed description which follows.

BRIEF DESCRIPTION OF THE DRAWING

The drawing comprises a single FIGURE illustrating schematically the various steps in the method of the present invention.

DESCRIPTION OF THE PREFERRED EMBODIMENT

Generally, with the present invention, a carrier film or substrate is provided for the heat transfer. Heat transfer inks are then printed on the carrier film by means of known flexographic or letter press methods. Prior to printing of the heat transfer ink on the film, a coating may be applied to the film to improve abrasion resistance of the ultimate heat transfer. The coating thus is of a type which would be released from the film by the heat transfer operation.

Subsequent to printing of formulated inks upon the film, it is also an optional step of the invention to apply a coating of tying material or adhesion promotion material. The application of the pre and post ink materials may be by gravure methods or by any other suitable printing method. The inks, however, are generally applied by flexographic or letterpress methods. The sequence of operations is illustrated in the drawing.

Preferably the plates used for the letter press or flexographic printing of the transfer inks are plastic plates which provide for high resolution printing. Typical plastic plates include those made from photopolymer resins such as the tradename products Cyrel by Dupont and Nyloprint by BASF.

Preferably the general composition of the printing inks is as follows:

Organic pigment or dye: 1–30% by weight
Alcohol solution acrylic resin: 3–12% by weight
Cellulose acetate butyrate: 0.5–5% by weight
Dispersion agents: 0.0–2% by weight
Ethanol (solvent): 25–50% by weight
Butyl cellosolve (solvent): 5–12% by weight
*Pentoxone (solvent): 0.0–3% by weight
2-Nitro propane (solvent): 10–25% by weight
N-propyl acetate (solvent): 5–15% by weight

*Registered trademark of Shell Chemical Company-4 methoxy 4 methyl pentanone-2 (solvent).

The following examples give various examples of combinations of carriers, printing inks, tie down materials and release materials which may be used in the printing process.

EXAMPLE 1

A roll of polyester film 0.001" in thickness was precoated with a release coating as follows:

*Elvacite 2041—15%
Toluene—40%
Methyl ethyl ketone—35%

*A high molecular weight acrylic resin supplied by Dupont Co.

This coating is applied by gravure or metering bar process to give a dry coating weight of 0.2 grams per square meter.

Inks can be printed over this layer. The inks typically have the following formulations:

| (1) BLUE INK | Supplier | Percentage by Weight |
|---|---|---|
| Phthalocyanene blue pigment | Dupont | 7.70 ± 3.00 |
| Orasol solvent soluble dye | Ciba Geigy | 4.20 ± 2.00 |
| Titanium dioxide | Dupont | 1.40 ± 1.00 |
| [1]Elvacite 2013 | Dupont | 9.23 ± 3.00 |
| Cellulose acetate butyrate | Eastman Kodak | 2.28 ± 1.50 |
| [2]Span 80 | I.C.I | .04 ± .02 |
| [3]G. 3300 | I.C.I. | .04 ± .02 |
| Ethanol | | 34.17 ± 5.00 |
| Pentoxone | Shell Chemical | .71 ± 1.50 |
| Butyl cellosolve | | 8.02 ± 2.50 |
| [4]Paraplex G. 60 | Rohm and Haas | 3.49 ± 1.75 |
| 2. Nitro propane | | 19.42 ± 5.00 |
| N-propyl acetate | | 9.30 ± 5.00 |
| | | 100.00% |

[1]Elvacite 2013 - a low molecular weight methyl/n butyl methacrylate copolymer resin
[2]Span 80 - sorbitan mono oleate, wetting agent
[3]G. 3300 - ionic surfactant - ackyl aryl sulphonate, dispersant
[4]Paraplex G. 60 - a polymeric plasticizer

| (2) YELLOW INK | Supplier | Percentage by Weight |
|---|---|---|
| Dalamar yellow pigment | Dupont | 4.99 ± 5.00 |
| Orasol yellow 2 gln. dye | Ciba Geigy | 3.00 ± 2.00 |
| Titanium dioxide | Dupont | 1.46 ± 1.00 |
| Elvacite 2013 | Dupont | 10.62 ± 3.00 |
| Cellulose acetate butyrate | | 2.64 ± 1.50 |
| Span 80 (sorbitan oclate) | I.C.I. | .18 ± .10 |
| G. 3300 (Alkyl aryl sulphonate) | I.C.I. | .18 ± .10 |
| Ethanol | | 34.46 ± 5.00 |
| Pentoxone (4-Methoxy 4-Methyl Pentanone-2) | Shell Chemical | 1.93 ± 1.50 |
| Butyl cellosolve | | 5.49 ± 2.50 |
| N-propyl acetate | | 12.70 ± 5.00 |
| Paraplex G. 60 (polymeric plasticizer) | Rohm and Haas | 2.40 ± 1.75 |
| 2. Nitro propane | | 19.95 ± 5.00 |
| | | 100.00% |

| (3) WHITE INK | Supplier | Percentage by Weight |
|---|---|---|
| Titanium dioxide | Dupont | 29.88 ± 7.50 |
| Elvacite 2013 (Methyl Butyl Methacrylate) | Dupont | 9.50 ± 3.00 |
| Cellulose acetate butyrate | | 2.29 ± 1.50 |
| 2. nitro propane | | 13.40 ± 5.00 |
| Butyl cellosolve | | 5.24 ± 2.50 |
| Ethanol | | 28.72 ± 5.00 |
| N-propyl acetate | | 7.05 ± 5.00 |
| Span 80 | I.C.I. | .06 ± .10 |
| G. 3300 | I.C.I. | .06 ± .10 |
| Pentoxone | Shell Chemical | 1.51 ± 1.50 |
| Paraplex G.60 | Rohm and Haas | 2.29 ± 1.75 |
| | | 100.00% |

The inks were printed using Dupont Cyrel photopolymer plates. On the application of heat and pressure the inks transferred cleanly and easily to an article made of high impact polystyrene giving a decoration with excellent abrasion resistance.

EXAMPLE 2

A coating consisting of Ouricury wax dissolved as a 5% solution in trichlorethylene was applied to 0.00075 polyester carrier film using a wire wound metering bar and inks as described in Example 1 above were printed using B.A.S.F. Nyloprint photopolymer or plastic plates.

The resultant print transferred easily and cleanly on application of heat and pressure to a plastic article made of polycarbonate resin.

EXAMPLE 3

A coating of Ouricury wax on polyester film as described in Example 2 was overcoated with the following abrasion resistant lacquer:

| | Supplier | Percentage by Weight |
|---|---|---|
| [1]V.Y.H.H. | Bakelite | 3.30 ± |
| [2]Acryloid A.101 (30% solution) | Rohm and Haas | 13.00 ± |
| [3]Chlorowax 40 | Diamond Shamrock | 2.70 ± |
| Methyl ethyl ketone | | 40.00 ± |
| Toluene | | 41.00 ± |
| | | 100.00% |

[1]V.Y.H.H. - medium molecular weight vinyl chloride-vinyl acetate copolymer
[2]Acryloid A.101 - high molecular weight methyl methacrylate
[3]Chlorowax 40 - chlorinated paraffin wax The coating was applied by wire wound metering bar giving a dry coating weight of 2–5 grams per square meter.

The duplex coated film was then printed on the flexographic press using Cyrel plates with the inks as described in Example 1.

The resultant multi-layer system, when applied by use of heat and pressure to polystyrene, resulted in a hard, abrasion and alcohol resistant decoration suitable for decorating cosmetic containers.

EXAMPLE 4

An overall key or tie coating was applied by using a plain Cyrel (Dupont) plate. The coating had the following formulation and was applied over previously inked film as described in above examples:

| | Supplier | Percentage by Weight |
|---|---|---|
| CP. 515-2 Chlorinated polyolefin Elvax 40 (10% in heptane) | Eastman Kodak | 39.00 ± 7.50 |
| Ethylene vinyl acetate | Dupont | 18.96 ± 5.00 |
| Aerosil 300 (Silica filler) | Degussa | 4.37 ± 7.00 |
| Heptane (solvent) | | 37.67 ± 10.00 |
| | | 100.00% |

This system gave good adhesion to polyethene and polypropylene when transferred using heat and pressure.

EXAMPLE 5

Inks based on the following formulations were printed from Cyrel® (Dupont) plastic printing plates onto release coated polyester film.

| | Supplier | Percentage By Weight | Range |
|---|---|---|---|
| [1]Krumbhaar Resin 1717 (50% solution) | Lawter Chemical Co. | 30.00 | 20–30% |
| Precipitated chalk (pigment) | | 21.00 | 5–25% |

-continued

| | Supplier | Percentage By Weight | Rang |
|---|---|---|---|
| [2]Versamid 750 (40% solution) | General Mills | 15.00 | 10–20 |
| Dye | | 4.00 | 0–7% |
| N-propyl acetate (solvent) | | 11.00 | 5–15 |
| Nitrocellulose (½ sel grade) | Hercules | 15.00 | 2–7% |
| Di-octyl phthalate plasticizer | | 2.00 | 0.5–3.5 |
| Titanium dioxide | | 1.80 | 0–7% |
| Dispersion agents | | 0.20 | 0–2% |
| | | 100.00% | |

[1]Krumbhaar Resin 1717 - condensed ketone resin
[2]Versamid 750 - polyamide resin On application of heat and pressure these inks wit out any further tie coat or adhesion promoter will a here to low and high density polyethene and polypr pylene.

In the examples, various ranges of constituents ha been set forth. Additionally, alternative componer have been identified.

While there has been set forth various preferred e bodiments of the method and formulations associat with the present invention, it is to be understood, ho ever, that various changes can be made while not d parting from the spirit and scope of the invention. Th the invention is to be limited only by the followi claims and their equivalents.

What is claimed is:

1. A method for manufacture of heat transfer dec comprising the steps of:

(a) providing a release coated carrier film from t group consisting of polypropylene coated pap cured melamine coated paper, epoxy coated pap and polyester film; and (b) printing on said film by means of flexograph methods with at least one ink from a group of in having the following formulation:
Pigment or dye: 1–30% by weight
Alcohol solution acrylic resin: 3–12% by weigh
Cellulose acetate butyrate: 0.5–5% by weight
Dispersion agents: 0.0–2% by weight
Ethanol: 25–50% by weight
Butyl cellosolve: 5–12% by weight
4 Methoxy-4 Methyl, Pentanone-2: 0.0–3% weight
2-Nitro propane: 10–25% by weight
N-propyl acetate: 5–15% by weight
Polymeric plasticiser: 1–5% by weight.

2. The method of claim 1 including the additional st of subsequently overcoating the printed inks with a t coat to promote added adhesion of said heat transfer a surface.

3. The method of claim 1 including the addition preliminary step of applying a precoat from the gro consisting of hard acrylic and resin to the film prior printing the ink on the film to provide added abrasi and solvent resistance for the heat transfer.

4. The method of claim comprising the step of pri ing said ink on the film by means of photopolymer pla tic printing plates.

5. The method of claim 1 comprising the step of pr viding a polyester carrier film with a coating from t group consisting of wax and resin.

6. The method of claim 5 including the additional st of subsequently transferring the transfer by heat a pressure onto polyolefinic plastic material.

7. The method of claim 1 including the step of provi ing a release substrate from the group consisting silicone and organic chromium complex for the carri film.

* * * * *